US005156305A

United States Patent [19]

Eyre

[11] Patent Number: 5,156,305

[45] Date of Patent: Oct. 20, 1992

[54] DISPENSING GUN

[75] Inventor: Christopher J. Eyre, Basingstoke, England

[73] Assignee: BBA Group PLC, United Kingdom

[21] Appl. No.: 673,060

[22] Filed: Mar. 21, 1991

[30] Foreign Application Priority Data

Mar. 22, 1990 [GB] United Kingdom ..... 9006391

[51] Int. Cl.[5] ..... B67D 5/42

[52] U.S. Cl. ..... 222/327; 222/391

[58] Field of Search ..... 222/326, 327, 391

[56] References Cited

U.S. PATENT DOCUMENTS

| | | | |
|---|---|---|---|
| 2,889,085 | 6/1959 | Collins | 222/391 |
| 4,009,804 | 3/1977 | Costa et al. | 222/391 |
| 4,033,484 | 7/1977 | Ornsteen | 222/391 X |
| 4,126,251 | 11/1978 | Subwick | 222/391 X |
| 4,461,407 | 7/1984 | Finnegan | 222/391 |
| 4,509,662 | 4/1985 | Weiss | 222/391 |
| 4,681,524 | 7/1987 | Ikeda et al. | 222/391 X |
| 4,706,853 | 11/1987 | Stonesifer et al. | 222/391 |

FOREIGN PATENT DOCUMENTS

| | | | |
|---|---|---|---|
| 1555455 | 11/1979 | United Kingdom | 222/391 |

*Primary Examiner*—Andres Kashnikow
*Assistant Examiner*—Anthoula Pomrening
*Attorney, Agent, or Firm*—Olson & Hierl, Ltd.

[57] ABSTRACT

A dispensing gun for viscous materials comprises a stock supporting a push rod which is advanceable along a keep in which is mounted a cartridge of the material. The rod is advanced by means of a catch plate and trigger arrangement which bites on the rod and is retreated by a return spring. A release plate prevents the rod retreating with the catch plate. The release plate is frictionally engaged with the rod so that it acts as a lost motion brake once force is removed from the trigger. In this way the rod is allowed a limited retreat to take the dispensing force off the cartridge to prevent leakage when the trigger is not depressed.

10 Claims, 2 Drawing Sheets

DISPENSING GUN

BACKGROUND OF THE INVENTION

1. Field of the Invention

The present invention relates to dispensing guns for dispensing viscous materials which may be of a thick liquid or pasty nature.

2. Description of the Prior Art

Viscous material, such as mastic caulking material, is commonly supplied in a cartridge having a discharge nozzle. The cartridge can be mounted in a dispensing gun. An example of such a dispensing gun is described in British patent GB1555455. The gun has a plunger or push rod slidably mounted in a stock. The cartridge is mounted in a keep before the plunger which is advanced by means of a gripper plate and trigger assembly to force a piston, inside one end of the cartridge, forward to urge the material from the nozzle at the other end. The trigger and gripper plate are reset at the end of a dispensing stroke and the dispensing force can be reapplied. During dispensing the plunger is held against the end of the cartridge between trigger strokes by means of a locking plate.

By maintaining and reapplying a constant force on the trigger, it is found that it is possible to exert a high degree of control over the rate of discharge of the mastic material. However, while the gun is entirely acceptable as a dispensing tool for viscous materials in most situations, it is sometimes desirable to be able to halt the discharge immediately, when the hand releases the trigger. However, it is found that the body of the cartridge expands radially under a dispensing force. Similarly, if any pockets of gas are trapped in the cartridge they will compress during discharge of the material and expand once the dispensing force is removed. As the plunger is held by the locking plate substantially in the position at which the dispensing force was removed from the trigger, the contracting cartridge and any expanding pockets of gas tend to cause continued dispensing of the material when it is not required unless the locking plate is released manually.

SUMMARY OF THE INVENTION

According to the present invention there is provided a dispensing gun for dispensing viscous material from a cartridge, the gun comprising a stock, means for holding a cartridge projecting from the stock, a push rod longitudinally movably mounted in the stock and arranged to extend generally in the direction in which the cartridge projects from the cartridge holding means, means for engaging the rod to advance it, brake means movable between a released relationship with the rod, in which the rod is movable relative to the stock, and an engaged relationship, in which the rod is held relative to the stock, characterized in that the brake means are carried by the rod to the released and engaged relationships as the rod is respectively advanced and retreated.

Thus, the brake means are biased by advancement of the rod to the released position.

In this way, the brake means are arranged to move with the rod as it retreats until the brake means are carried into the engaged relationship by the rod. Thus, the invention can be considered as a lost motion brake providing limited movement of the rod when a dispensing force is removed from the trigger. This has the effect of taking the load off the cartridge and bringing dispensing of the material to an abrupt halt. As a consequence, there is substantially no oozing of the dispensed material, caused by the rod being held against the cartridge, when the trigger is released.

Furthermore, the release of the rod from being hard up against the cartridge means that the biting brake means are not under less force than in the known dispensing gun. The result is that the rod tends not to be marked by biting parts of the engaged brake means.

Conveniently, the engagement between the rod and the brake means is frictional. This may be by means of a an elastomeric member, for example a bush, such as an O-ring received on the rod.

This means effecting frictional engagement may be mounted on the brake means. However, it may also be mounted to one side. The frictional engagement may also be effected in any of a variety of other ways apparent to the skilled person.

The brake means may conveniently be movably attached to the stock. The brake means may be a plate having a recess, aperture or other formation defining an edge which is arranged to bite on the rod to engage therewith. Alternatively, the brake means could be any suitable form of brake which is arranged to be carried by the rod and move with it into a braking position to limit its retreat.

In particular, the brake means are carried forward with the advancing rod to the release position. When the rod is no longer advanced it has a tendency to retreat slightly. Again, the brake means are carried with it this time to brake the rod after the brake means have moved with the rod between the two positions.

In one particular form of the invention the means for advancing the rod are a catch or gripper plate which reciprocates along the rod by engaging it in a first biting attitude and advancing the rod with it and then being slipped back on the rod to repeat the procedure. As the catch plate slips, the rod retreats slightly with it, carrying the braking means to the engaging position. At this point the retreat of the rod is halted. Preferably, the catch plate is actuated by a trigger pivotably mounted in the stock and biased to the slipped position by a spring bearing against the stock.

DETAILED DESCRIPTION OF THE ILLUSTRATED EMBODIMENT

Figure 1:
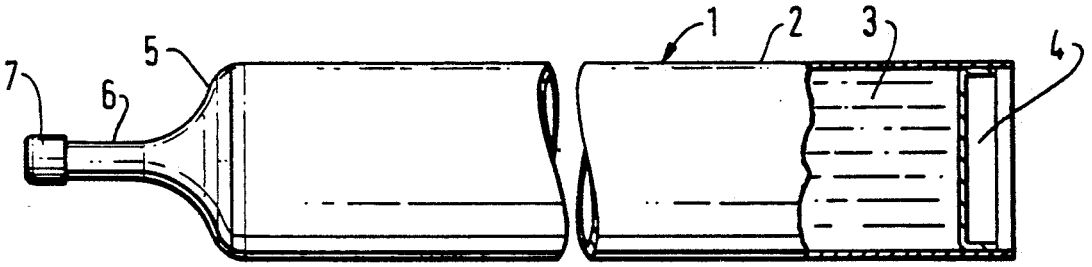
FIG. 1 illustrates a cartridge, partly in side elevation and partly in side section.
Figure 3:
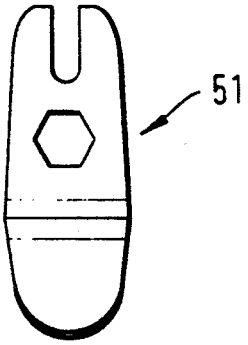
FIG. 3 illustrates a release plate used in the gun of FIG. 2.
Figure 4A:
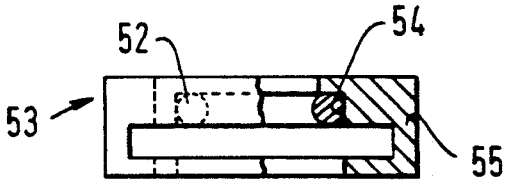
FIGS. 4*a*) and *b*) illustrate, partly in section, a bush housing carried on the catch plate of FIG. 3.
Figure 4B:
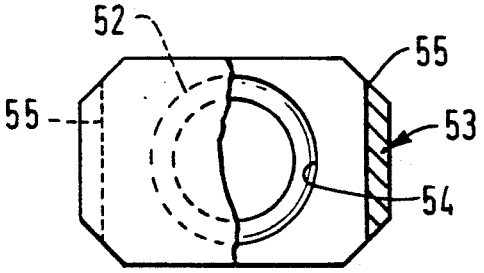

The cartridge 1 shown in FIG. 1 has a generally cylindrical body 2 containing viscous material 3 such as a caulking mastic. The cylindrical body is open at one end and contains a free cup-shaped piston 4 which is slidable along the length of the body 2. The opposite end of the cartridge is constricted to form a shoulder 5 leading to a nozzle 6 having an open end closed by a cap 7.

The gun 11 and parts therefor shown in FIGS. 2 to 4*a*) and *b*) is intended to dispense material from the cartridge 1 and comprises a stock 12 and a cartridge keep 13. The keep 13 comprises two elongate side frame members 15, the end of each member 15 merging with the stock 12. The opposite ends of the side frames 15 are connected to an annular generally cup-shaped member 19 having a large opening in its base.

A hexagonal section push rod 22 is mounted in the stock 12 for movement longitudinally of itself and with its axis lying midway between the two side frames 15. At one end of the rod 22 there is plunger 23 which engages the piston 4 of the cartridge, while the other end is formed as a hook 24 by which the gun may be suspended when it is not in use and which acts as a handle by which the rod 22 may be moved longitudinally. The section of the push rod could be another non-circular shape or circular. However, the flats presented by the hexagonal rod 22 are found to be particularly engageable by the catch plate and release plate to be described.

A rest 20 bridges the members 15 near the stock 12. The rest 20 cooperates with the cup shaped member 19 to serve to hold the cartridge 1 in position before the push rod 22 is advanced to engage the piston 4.

The stock 12 is formed with a large central aperture 25 and on either side there are hexagonal section guide holes 26 and 27. Each guide hole is defined by forward and rear oppositely extending portions 28 and 29, and 30 and 31; respectively. Each portion defines two side faces and the upper and lower faces of the hexagonal shape.

Figure 2:
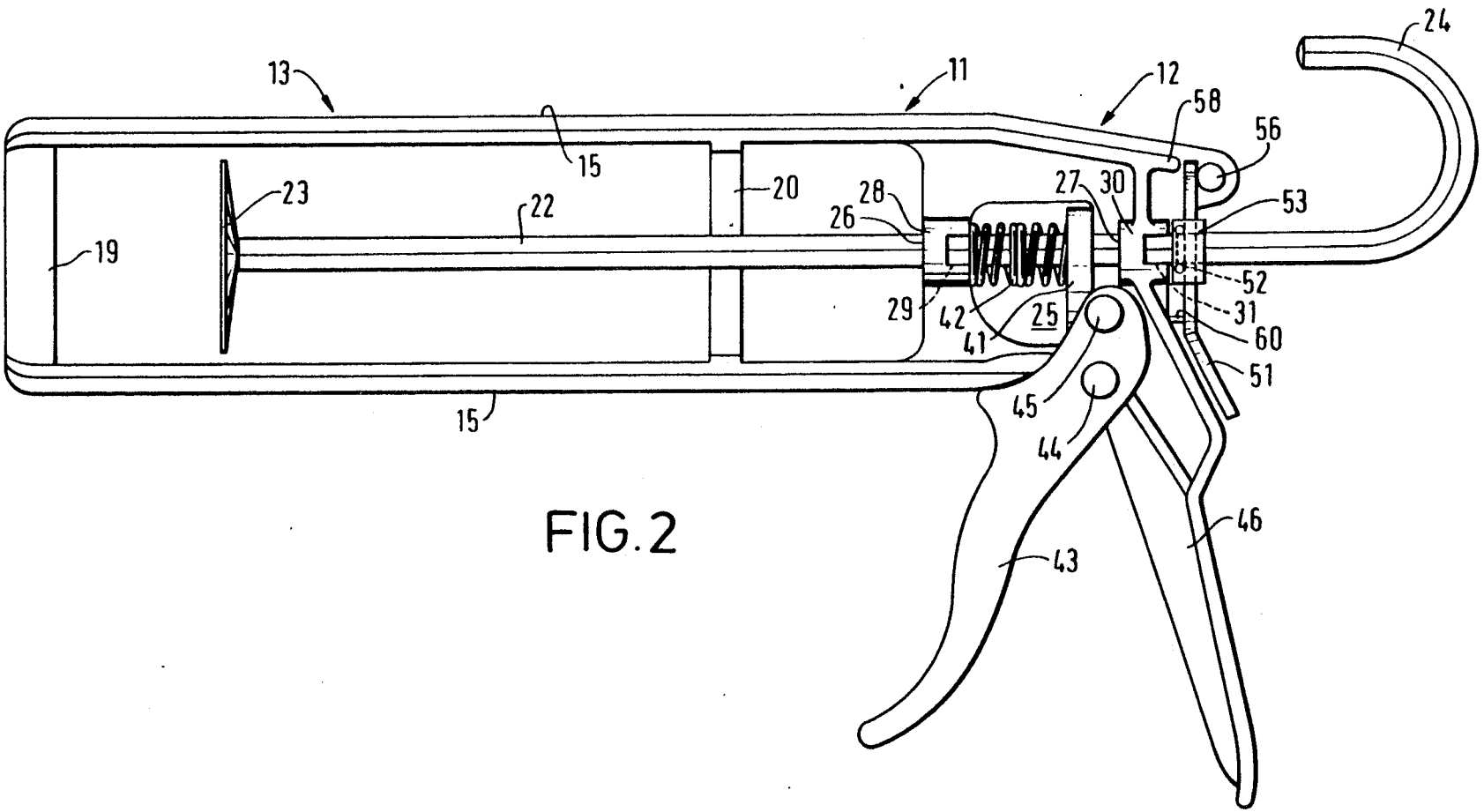
FIG. 2 illustrates a dispensing gun according to the invention.

The rod can be moved incrementally by a mechanism comprising a catch plate 41 having a modified hexagonal opening through which the rod 22 passes and which is only slightly wider than the rod. The aperture is formed with side faces angularly coincident with the corresponding flats of the rod. However, the top and bottom of the aperture are not flat but radiused. This allows a clearance to take account of wear of the catch plate 41. The action of the catch plate 41 (to be described below) tends to cause wear of its side faces. The radiused clearance at top and bottom of the aperture accommodates for this wear without allowing the top and bottom surfaces of the rod to contact the plate and thus impair the engaging action between the two. The catch plate 41 is guided by the fit of the hexagonal section rod in the hole and is biased to the right, as seen in FIG. 2, by a compression spring 42 surrounding the rod 22.

The catch plate 41 can be tilted to engage the rod and advance it by means of a trigger 43 pivoted on the stock 12 by a rivet 44, the trigger 43 having an actuating end comprising a pair of flanks which are bridged by a further rivet 45 which engages the catch plate 41. The stock 12 has an integral butt portion 46 which extends downwardly and generally perpendicularly to the axis of the rod 22 and, when the trigger 43 is pulled, the butt portion 46 lies generally within the hollow of the shaped trigger.

The keep 13, the stock 12, and the butt portion 46 are molded as a unitary item from glass filled nylon. The trigger 43 is made of the same glass filled nylon. Alternatively, the mastic gun could be made substantially of metal stamped parts as described, for example in GB 1555455.

At the end of the stroke of the trigger 43, retreat of the advanced rod 22 is limited by a release plate 51 which is formed with a hexagonal clearance hold through which the rod extends. The release plate 51 is loosely held in relation to the stock by laterally extending abutments 56 projecting from either side of the rear of the stock 12. The release plate 51 is able to move between a rod engaging attitude and released attitude in relation to the rod. This movement is described below.

A rod engaging O-ring bush 52 is also received on the rod 22 on the side of the release plate 51 adjacent the stock 12. The bush 52 is held to move with the release plate 51 by means of a bush housing 53 which also has an aperture for the rod 22. The bush is held in an annular recess 54 formed in the housing and the housing itself is held on the release plate 51 by arms 55 which wrap around the sides of the plate. It should be emphasized that FIGS. 3 and 4*a*) and *b*) are not to the same scale.

In an alternative embodiment the rod engagement performed by the O-ring is provided by a one piece molding, constituting both the bush 52 and the housing 53.

The position of the release plate 51 in an engaging attitude is defined by the laterally extending abutments 56 on the stock 12 against which the plate bears when the rod 22 is urged to retreat. The released attitude of the plate 51 is defined by the end of a pair of adjacent ridges 58 on the stock 12 and a shoulder 60 on the top of the butt portion 46. These co-operate to hold the release plate 51 in an upright attitude as the rod 22 is advanced.

The push rod 22 is advanced to dispense the material from the cartridge 1 mounted in the keep 13 by depressing the trigger. This causes the side edges of the catch plate 41, defining the aperture, to bite on the rod as its attitude is urged to change by the trigger movement. Thus, the rod is advanced with the plate 41. At the end of a stroke of the trigger, which may be at its extreme of travel or an intermediate point, the catch plate 41 (and hence the trigger 43) is urged to retreat by the spring 42.

Although the biting side edges of the retreating catch plate 41 will slip over the rod, there is a tendency for the rod 22 to be carried back with the plate 41. Also, as the rod 22 retreats it carries with it the frictionally engaged bush/release plate assembly from the released, upright, attitude to a braking attitude. Eventually, the movement of the rod is arrested by its engagement with the edges of the release plate 51 which abuts the abutments 56 to swing into the engaged attitude.

Thus, between the released and locking positions of the release plate, the rod 22 is free to retreat with the catch plate. The release plate then bites on the rod and arrests any further backward movement.

The limited retreat of the rod 22 has the beneficial effect of relieving the dispensing force of the push rod from the cartridge. As a consequence, the flow of material from the cartridge is halted virtually as soon as the trigger is released.

To retreat the rod 22 fully to insert in it the cartridge, the release plate 51 is simply held in the released position, abutting the ridges 58 and the shoulder 60. The rod 22 is then simply pulled back.

It is to be understood that only preferred embodiments of the invention have been described and that numerous alternations, substitutions and modifications may be made without departing from the spirit and scope of the invention as defined in the following claims.

What is claimed is:

1. A dispensing gun for dispensing viscous material from a cartridge, the gun comprising a stock, means for holding a cartridge projecting from said stock, a push rod longitudinally movably mounted in said stock and arranged to extend generally in the direction in which said cartridge projects from said cartridge holding means, means for engaging said rod to advance it, brake means movable between a released relationship with said rod, in which said rod is movable relative to said stock, and an engaged relationship, in which said rod is held relative to said stock, said brake means being carried by said rod to said released and engaged relationships, as said rod is respectively advanced and retreated, a rod engaging member secured relative to said brake means, said rod engaging member being frictionally engaged with said rod whereby said frictional engagement permits the said rod to slide relative thereto as it is advanced.

2. The dispensing gun of claim 1 in which said rod engaging member is a bush embracing said rod.

3. The dispensing gun of claim 2 in which said bush is an elastomeric ring.

4. The dispensing gun of claim 2 in which said bush is housed in a housing received on said brake means, said housing being formed with a recess past which said rod extends and in which said bush is disposed.

5. The dispensing gun of claim 1 in which said brake means are a release plate defining an aperture shaped to accommodate said rod, the aperture having a side edge arranged to bite on said rod in the engaged relationship,

6. The dispensing gun of claim 1 in which brake means are retained by said stock to move with said rod between said released and engaged relationships at positions defined by features on the said stock.

7. The dispensing gun of claim 1 in which said means for engaging said rod are a catch plate which is reciprocable relative to said stock to engage said rod and advance it.

8. The dispensing gun of claim 7 in which said catch plate is advanced by an actuating lever engaging said catch plate.

9. The dispensing gun of claim 7 in which resilient means bias said catch plate to a disengaged attitude with respect to said rod.

10. A dispensing gun for dispensing viscous material from a cartridge, the gun comprising a stock, a keep for holding said cartridge projecting from said stock, a push rod longitudinally movably mounted in said stock and arranged to extend generally in the direction in which said cartridge projects from said keep, a catch plate having a first aperture through which said rod extends, the catch plate being arranged to engage said rod by means of a trigger actuated lever to advance the rod, a brake plate having a second aperture through which said rod also extends, the brake plate being movable between a released orientation with respect to the rod, in which said rod is movable relative to said stock, and an engaged orientation, in which said rod is held relative to said stock, said brake plate being carried by said rod to said released and engaged orientations, as said rod is respectively advanced and retreated, by a rod engaging resilient bush secured relative to said brake plate which said bush is frictionally engaged with said rod, whereby said frictional engagement permits the said rod to slide relative thereto as it is advanced.

* * * * *